US005103696A

United States Patent [19]

Beuke

[11] Patent Number: 5,103,696

[45] Date of Patent: Apr. 14, 1992

[54] PRESSURE-OPERATED POWER WRENCH

[75] Inventor: Karl Beuke, Neunkirchen, Fed. Rep. of Germany

[73] Assignee: Paul-Heinz Wagner, Fed. Rep. of Germany

[21] Appl. No.: 640,725

[22] Filed: Jan. 14, 1991

[30] Foreign Application Priority Data

Jan. 13, 1990 [DE] Fed. Rep. of Germany ..... 4000815
Jan. 24, 1990 [DE] Fed. Rep. of Germany ..... 4001943

[51] Int. Cl.[5] ..... B25B 13/46
[52] U.S. Cl. ..... 81/57.39; 81/57.44
[58] Field of Search ..... 81/57.39, 57.44

[56] References Cited

U.S. PATENT DOCUMENTS 4,805,496 2/1989 Wagner et al. ..... 81/57.39
5,003,847 4/1991 Wagner ..... 81/57.39
5,005,447 4/1991 Junkers ..... 81/57.39

*Primary Examiner*—James G. Smith
*Attorney, Agent, or Firm*—Diller, Ramik & Wight

[57] ABSTRACT

The power wrench is provided with two pistons (38,41) arranged within each other. The pistons (38,41) abut against a pressure member (26) for pivoting a lever (18). The lever (18) is connected by an annular member (14) to the bolt head to be rotated. In a working stroke, the path of the first piston (38) is limited in that this piston impinges onto an abutment (46) while the second piston (41) moves on. The largest part of the working stroke is performed exclusively by the second piston (41) and thus is effected with low hydraulic throughput. When the force of the second piston (41) is not sufficient anymore, the working strokes are performed by both pistons (38,41) in common over the shorter piston path.

18 Claims, 4 Drawing Sheets

PRESSURE-OPERATED POWER WRENCH

BACKGROUND OF THE INVENTION

The invention is directed to a pressure-operated power wrench.

Power wrenches, as disclosed e.g. in U.S. Pat. No. 4,805,496 are provided with a headpiece having an annular member rotatably supported thereon. The annular member is engaged by a lever including a ratchet, which lever can be pivoted by the power of a hydraulic piston displaceably arranged in a cylinder. The unit consisting of the piston and the cylinder can be a single-acting unit wherein the piston is pushed into its retracted position by a spring, or a double-acting unit wherein the pressure chamber is provided on one side of the piston and a counterpressure chamber is provided on the other side, with the pressure chamber and the counterpressure chamber being alternately pressurized and depressurized.

Known hydraulic power wrenches suffer from the disadvantage that, in a working stroke, the whole pressure chamber on the one side of the piston has to be filled with pressure oil. Due to the hydraulic resistance of the duct feeding the pressure chamber and due to the valves contained in said duct, the pressurizing of the pressure chamber requires a relatively long time with each working stroke. In the initial phase of the rotating of a bolt, the load moment of the bolt is small, so that, for moving the piston, already a relatively small force would be sufficient. Nevertheless, during each working stroke, the whole pressure chamber is filled with pressure oil. This relatively large oil throughput, with a large quantity of oil being pressed through hoses and valves, further results in the oil being excessively heated. Thus, in the pressure aggregate, consisting of a compressor and a pressure container, there is required a correspondingly large cooling capacity whereby the pressure aggregate becomes expensive and bulky.

In the power wrench of U.S. Pat. No. 4,919,018, the drive means comprises, instead of the otherwise common sole cylinder, two parallel cylinders which are moved synchronously with each other and in common generate the power for moving the lever and for rotating the annular member. Using two cylinders with appertaining pistons has the purpose of multiplying the force of a single cylinder unit so as to effect larger screwing moments. Concerning oil throughput and the time required for rotating the bolt, however, the conditions are the same as in a power wrench having one cylinder only.

SUMMARY OF THE INVENTION

It is the object of the invention to provide a hydraulic power wrench wherein the time required for rotating a bolt and the power required for the pressure aggregate are decreased.

In the power wrench of the invention, there are provided at least two pistons to be moved independently from each other, one of the pistons in its working stroke moving over a shorter distance than the other piston. This has the result that, in case of easy motion of the rotated bolt, i.e. with the moment of resistance being low, both of the pistons are put to work. The additional piston moves over the longer distance and causes the primary rotational movement of the bolt while the first piston takes part in this rotational movement only over a relatively short distance. The second cylinder has a smaller sectional surface than the first cylinder, so that only a reduced quantity of a pressure medium is needed for each working stroke. In case of a high load moment of the bolt to be rotated, the force of the additional piston is not sufficient, so that the rotating action is performed only over a relatively short piston path, i.e. over a relatively small angle of the lever, with both pistons in common. Both pistons move exclusively over the relatively short traveling path of the first piston, so that only short working strokes are carried out. Although this lengthens the required time for the actual fastening of the bolt (or for the actual loosening of a fixed bolt), it has to be considered that, normally, the time wherein the bolt is rotated without any load moment to be overcome is much longer than the time wherein application of a large force is really indispensable. By the power wrench of the invention, the time required for the overall screwing process, i.e. for rotation against low resistance and rotation against high resistance, is cut down to about half of the otherwise necessitated time because the rotation against low resistance is, for the largest part, performed only with the additional piston whose cylinder is relatively small in volume. Due to the reduced power requirements to be met by the pressure aggregate (reduced quantities of the pressure medium), it is possible to use pressure aggregates having a much lower power and being much smaller in volume than would be practicable using common power wrenches.

The power wrench of the invention, being small and compact in design, can be arranged for performing a very large stroke while the load moment is small, with the lever being moved over a large rotational angle. Also this feature contributes to reducing the time necessitated for rotating a bolt.

It often occurs that bolts are not tightened in a single working step but that tightening of the bolts is performed in a plurality of steps. If, for instance, a reactor cover is to be fastened to a reactor by numerous bolts, it is normally required that, initially, in a first step, all of the bolts are screwed down until a certain load moment is reached and only subsequently, in a second step, the actual tightening of the bolts is carried out. The power wrench of the invention is suited to this kind of a working procedure due to the fact that the pressure acting on the second piston can be limited to a limit pressure by a pressure-limiting valve. In this case, the power wrench operates exclusively with the second piston until the screw has been biased to a desired load moment. When all of the bolts have been biased in this manner, tightening can be effected subsequently in that both pistons (or all pistons, respectively) are put to work in common so that the piston forces are combined with each other.

For enabling high-precision biasing of bolts up to a desired limiting rotational moment, the first piston can be made inoperative as provided by a preferred embodiment of the invention. This is accomplished in that the pressure member which transmits the piston force onto the lever is restricted in its moving range such that the pressure member cannot be reached anymore by the first piston. Thereby, only the additional piston can act on the pressure member and move the lever. The first piston is carried along empty but does not contribute to the generation of force and, thus, does not cause any noteworthy power consumption.

The invention is adapted for hydraulically operated power wrenches as well as for pneumatically operated power wrenches. Further, the invention is applicable in power wrenches having double-action piston-cylinder units and in power wrenches having single-action piston-cylinder units wherein the return stroke is effected by a spring means and only a single pressure-medium connection is provided.

BRIEF DESCRIPTION OF THE DRAWINGS

Embodiments of the invention will be described in greater detail hereunder with reference to the drawings. In the drawings

DESCRIPTION OF THE PREFERRED EMBODIMENT

Figure 1:
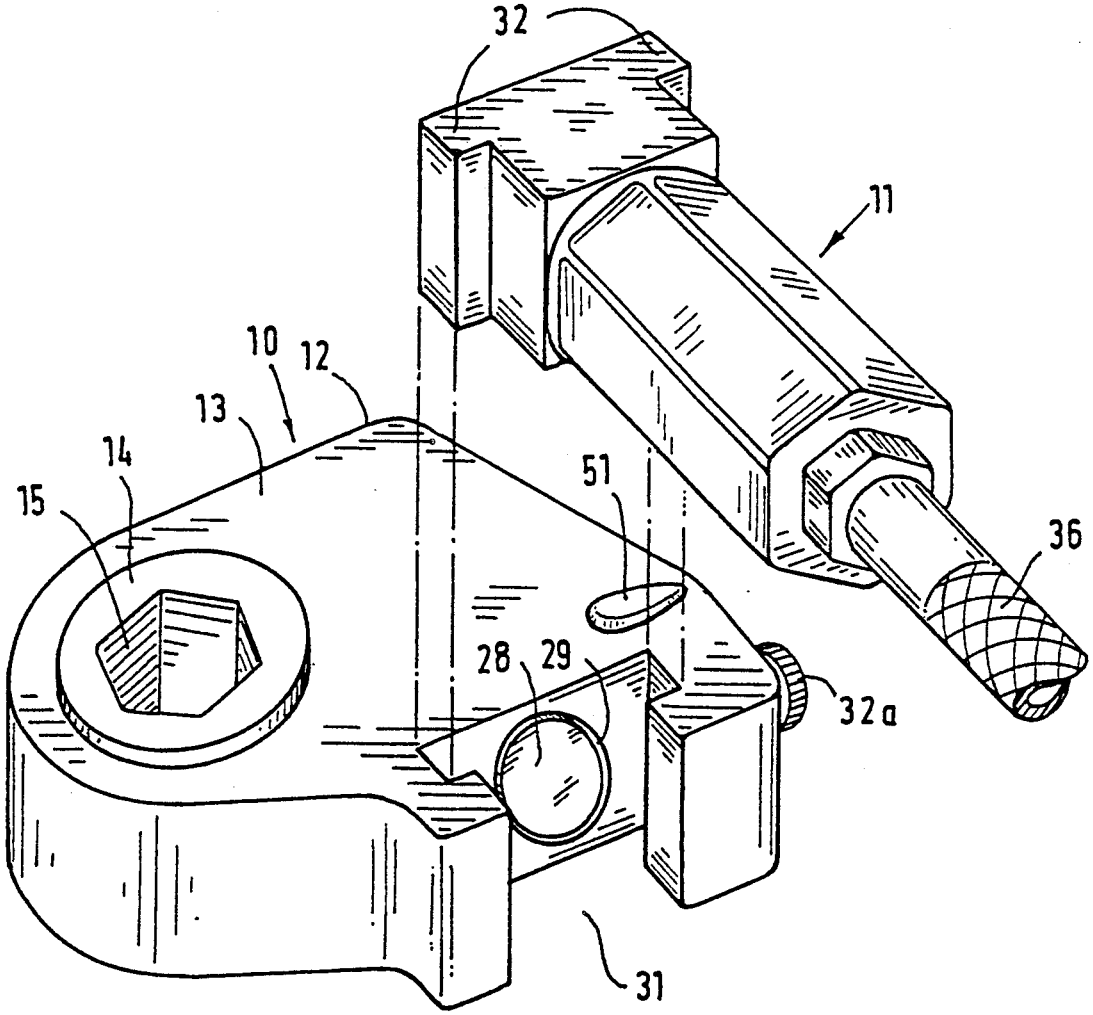
FIG. 1 is a perspective view of a two-part power wrench.

The power wrench of FIGS. 1 to 5 consists of a headpiece 10 and a drive unit 11 adapted for being coupled to the headpiece 10.

Headpiece 10 comprises a one-pieced hollow steel housing 12 having two parallel side walls 13. Said side walls have formed therein two coaxial openings for insertion of an annular member 14 extending through the housing. Annular member 14, being replaceable, has an inner profile 15 to be plugged onto a bolthead. In the present embodiment, inner profile 15 is a hexagonal profile.

Within housing 12, annular member 14 is provided with an outer toothing 16. A ratchet member 17, consisting of a wedge-shaped ratchet shoe and being arranged in a recess of a lever 18, cooperates with outer toothing 16. Lever 18 is supported on annular member 14 to be pivoted about the axis thereof. Ratchet member 17, by a concave toothed surface 19 thereof, engages with the outer toothing 16 of annular member 14. The rear end of ratchet member 17 is supported on the plane surface of a flattened cylindrical support body 20 seated in a cylinder pan of lever 18.

The cylinder pan extends over a circumferential angle slightly larger than 180° so that support body 20 can be removed therefrom only when being displaced in longitudinal direction. Support body 20 automatically adjusts itself to the varying inclinations of ratchet member 17. Orientation of ratchet member 17 is such that, upon movement of annular member 14 in one rotational direction, ratchet member 17 lifts off from outer toothing 16 so that annular member 14 can be freely rotated in this direction, and that, upon movement of annular member 14 in the opposite direction, ratchet member 17 locks the annular member 14 by its toothing. A spring 21 supported on lever 18 presses ratchet member 17 into its locking position.

The lever 18, pressed towards the drive unit 11 by a spring 22, comprises a pin-bearing bush 23 having supported therein a pin 24 extending transverse to lever 18. The two ends 24*a* of pin 24 (FIG. 4), protruding from lever 18, have planar pressure faces 25 abutting against the two legs of a bifurcated pressure member 26. Each of said legs has its front end provided with a planar sliding face 27. These sliding faces 27, being arranged in a common plane, are oriented at an inclination, i.e. they extend non-rectangular to the longitudinal direction of the pressure member 26. Arrangement of the sliding faces 27 is such that, in the intermediate position of lever 18, when the straight line passing through the centers of annular member 14 and of the pin support 23 is in the position 18*a* represented by the chain-dotted line in FIG. 2, sliding faces 27 extend substantially radially to the pin axis of lever 18. Therefore, upon displacement of pressure member 26, possible forces acting in longitudinal direction of lever 18 are kept as small as possible and the pressure force of pressure member 26 is transmitted to lever 18 with an almost exclusively tangential component, while the sliding faces 27 can slide along the support faces 25 of the rotatable pin 24.

The basis of pressure member 26 is provided with a connecting portion 28 fitted in an opening 29 of housing 12.

Housing 12 is closed by a cover 30. Through the corresponding opening, the described parts can be mounted in the integral housing.

As shown in FIG. 1, the drive unit 11 can be replaceably fastened to headpiece 10. To this purpose, headpiece 10 is provided with a receiving channel 31, arranged in parallel to the axis of annular member 14, for insertion of a holding head 32 of drive unit 11. Holding head 32 is secured by a bolt 32*a*, an arresting means or the like.

The drive unit 11 has a one-pieced housing 33 which contains a shell forming the first cylinder 34. At the rear end of said shell, there is arranged an end wall 35 provided with a connection for a pressure duct 36 and a connection for a return pressure duct 36'. The front end of cylinder 34 is sealingly connected to an end wall 35*a* supported on a threaded ring 37 screwed into an inner thread of housing 33.

The first piston 38, consisting of a piston head 38*a* sealed against cylinder 34 and of a piston rod 38*b*, is arranged for displacement in cylinder 34. In the retracted state, piston rod 38*b* extends into holding head 32 and abuts against connecting portion 28 of pressure member 26. The pressure in pressure chamber 39 pushes the piston in the direction of headpiece 10. The counterpressure chamber 52 is connected to return pressure duct 36' via bores 55 of cylinder 34 and through a channel 56 shown by chain-dotted lines.

The second cylinder 40, with the second piston 41 displaceably held therein, is arranged within hollow piston 38. The rear end of piston 41 has a flange 42 abutting a snap ring 43 of piston 38 for limiting the retracting movement of second piston 41. Flange 42 has no sealing effect against cylinder 40 so that the pressure prevailing within cylinder 40 is always the same as in pressure chamber 39. Sealing of piston 41 against cylinder 40 is provided by a sealing member 58 arranged at the front end of piston rod 38*b*. The force acting on second piston 41 equals the product of the pressure in pressure chamber 39 and the piston section at the location of sealing member 58.

Cylinder 40 accommodates a spring 44 surrounding piston 41. Spring 44 is supported on the front end of piston rod 38*b* and presses against flange 42. This spring 44 serves for the return stroke of piston 41. Such a return spring is necessary because the present example refers to a single-action piston-cylinder arrangement having only one pressure connection.

Piston 38 has provided thereon an abutment 45 cooperating with an abutment 46 and limiting the working path A of piston 38.

Return pressure duct 36' includes a switch valve 60 movable between two positions 60*a* and 60*b*. In position 60*a*, return pressure duct 36' is connected directly to the return system 61, and in position 60*b*, return pressure duct 36' is connected to return system 61 by a pressure-dependent back-check valve 62. Back-check valve 62 closes in the direction from return system 61 to return pressure duct 36' and opens towards return system 61 only when the pressure in return pressure duct 36' exceeds a predetermined limit value. Parallel to the pressure-dependent back-check valve 62, there is connected a back-check valve 63, closing in the direction from return pressure duct 36' to return system 61 and opening in opposite direction.

Starting from the position shown in FIG. 2, with valve 60 being in position 60*a*, the power wrench operates in the following manner: Upon pressurization of pressure chamber 39, both pistons 38 and 41 are advanced in common. These pistons, both of them pressing against connecting portion 28 of pressure member 26, cause a pivoting movement of lever 18 within housing 12 while the bolt head held in annular member 14 is taken along. It is a precondition that the power wrench is supported by a stationary back-up device for securing the wrench against being rotated as a whole. After passing through working path A, the abutment 45 of first piston 38 impinges against abutment 46 so that the first piston 38 cannot be advanced any further. Within first piston 38, however, second piston 41 goes on moving so that further rotation of lever 18 is effected exclusively by the action of piston 41. Since the volume of cylinder 40 is relatively small, only a small quantity of pressurized fluid is necessary for further advancement of piston 41.

When piston 41 has reached its front end position, the pressure within cylinder 40 is increased. This rise in pressure is detected by a pressure sensor (not shown) connected to duct 36 whereupon duct 36 is made pressureless. Spring 22 presses piston 38 backwards, and within this piston, spring 44 urges piston 41 backwards until flange 42 abuts against snap ring 43 of the first piston 38. Thus, both pistons are brought into their retracted position.

If, in a working stroke, the load moment of the bolt is so large that the force of piston 41 alone is not sufficient for rotating lever 18, the return stroke is immediately initiated by the described pressure control arrangement. The advance stroke covers only working path A wherein both pistons 38 and 41 are moved in common and with their forces combined. Thus, in case of a large load, the working strokes are short but are executed with large force.

In the above example, the two pistons are arranged telescopically within each other in coaxial orientation. It is also possible to arrange the pistons separately from each other.

For enabling rotation of a screw to a specific limiting rotational moment, a locking member 47 is provided in housing 12 for blocking the return movement of pressure member 26 at a position corresponding to the front end position of piston 38. Locking member 47 consists of a lever adapted to be pivoted about an axis 48 supported on housing 12 and to be brought into a locking position represented in FIG. 2 by dotted lines and illustrated in FIG. 3. In this locking position, which is safeguarded by an abutment 50, lever 47 engages behind an abutment 49 projecting from pressure member 26. In the locking position, the front end of locking member 47 is located at a distance B from the outmost retracting position, distance B being at least equal to distance A. This means that pressure member 26, in the locking position of locking member 47, is arrested in such an advanced position that the first piston 38, since its movement is limited by abutment 46, does not reach pressure member 26 anymore. In this constellation, the power wrench works exclusively with the second piston 41. Although piston 38 is reciprocated in the same manner as piston 41, piston 38 is carried along empty because it does not work against a load.

Adjustment of locking member 47 is performed by a lever 51 connected to axis 48 and movable between two abutments.

Figure 2:
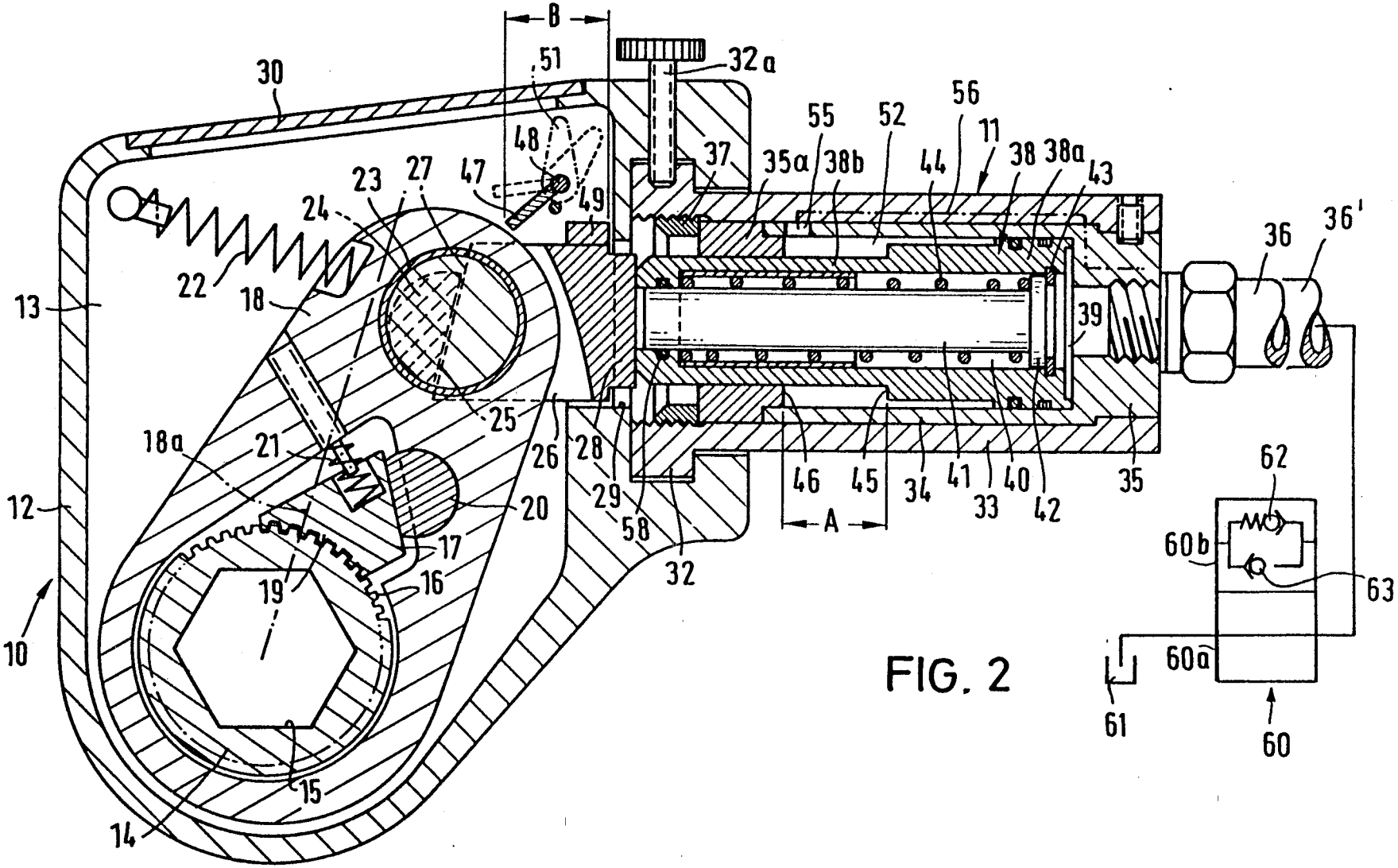
FIG. 2 shows a longitudinal section through the power wrench of FIG. 1.
Figure 3:
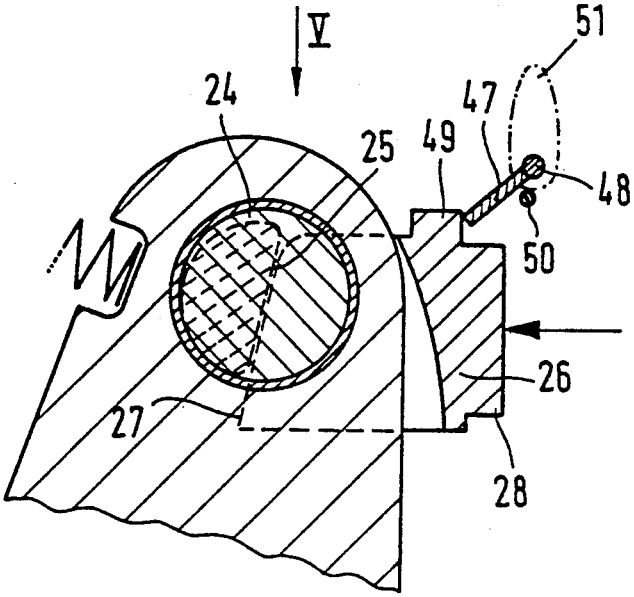
FIG. 3 shows the condition of the locking member being in its locking position.
Figure 4:
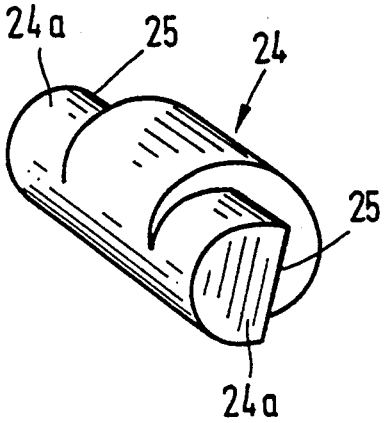
FIG. 4 is a perspective view of the pin, supported in the lever, to be engaged by the pressure member.
Figure 5:
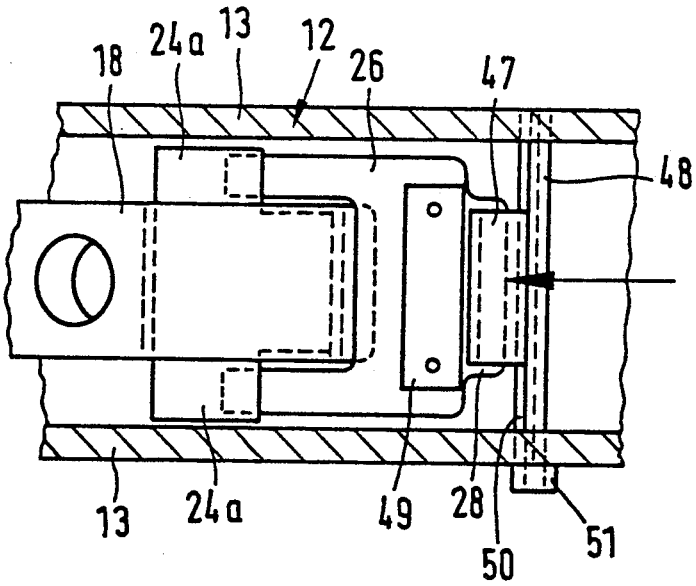
FIG. 5 is a plan view onto the arrangement of FIG. 3 from the direction of arrow V.

If locking member 47 is in its locking position while abutment 49 of pressure member 26 has not yet passed the locking member, i.e. if locking member 47 is in the position represented by dotted lines in FIG. 2 while pressure member 26 is in the position shown in FIG. 2, the pressure member can be advanced by the two pistons, with the locking member 47 evading. A spring (not shown) can be provided to the effect that the locking member can take up only two stable positions, the locking position and the release position.

If valve 60 is in position 60*b* and the load moment of the screw is still small, the pressure being generated in counterpressure chamber 52 is not sufficient to overcome the pressure-dependent back-check valve 62. Therefore, piston 38 remains at a standstill and lever 18 is moved exclusively by piston 41 being displaced by the pressure in pressure duct 36. The limit pressure force of piston 38 which is larger than the force of spring 44 exterted on piston 42. Thus, when the load moment is small, only piston 41 is advanced for moving lever 18.

When the load moment is increased, also the pressure in pressure duct 36 is increased. This pressure bears upon piston 38 and generates a high counterpressure in counterpressure chamber 52. When this counterpressure exceeds the limit value of back-check valve 62, the backcheck valve opens so that piston 38 is advanced together with piston 42 and acts on lever 18. At the end of the piston stroke, pressure duct 36 is switched into the pressureless state, and spring 22 drives piston 38 together with piston 42 back into the end position shown in FIG. 2, while counterpressure chamber 52, becoming larger in volume, causes oil to be sucked through return pressure duct 36'. The sucked oil flows through the back-check valve 63 of valve 60 which is permeable in this direction.

When the load moment is small, piston 38 is substantially at a standstill while only piston 42 is moved. When the load moment is large, however, both pistons 38 and 42 are moved in common, piston 42 substantially maintaining its position within piston 38. In the normal operating mode, valve 60 is in position 60*b*. When the rotational moment to which the screw is subjected is limited in dependence of the pressure in pressure duct 36, it can be necessary to operate the device in position 60*a* of valve 60, if the rotational moment is to be limited in an area within the range of the limit pressure of back-check valve 62.

Instead of the pressure-dependent back-check valve 62, a throttle member or some other hydraulic component can be used for effecting build-up of counterpressure in counterpressure chamber 52.

Figure 6:
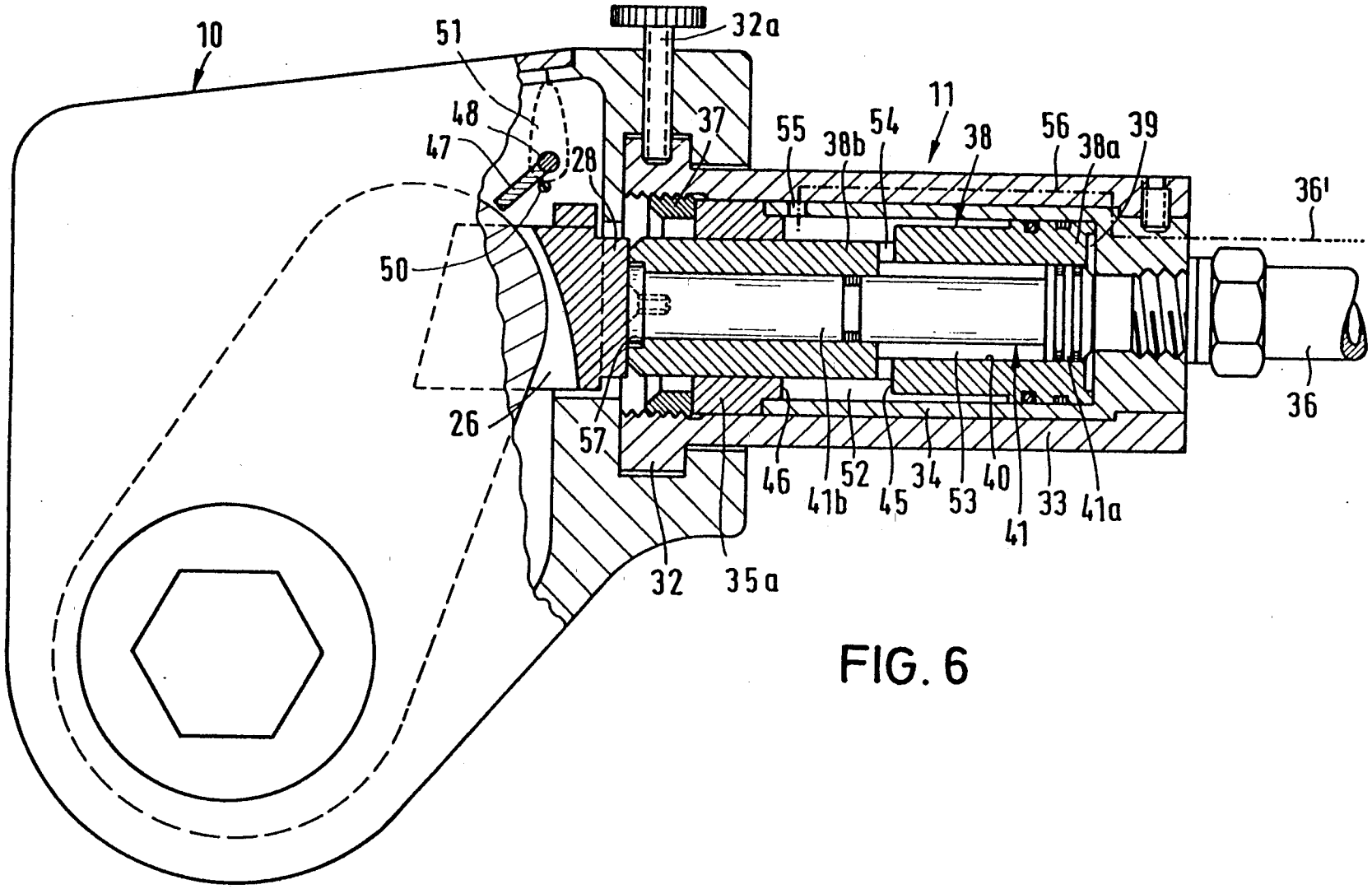
FIG. 6 is a view, partially in section, of a power wrench comprising a double-action piston-cylinder arrangement.

The embodiment according to FIG. 6 differs from the first embodiment only in that the drive unit is a double-action piston-cylinder device having two hydraulic connections 36 and 36' to be alternately connected by a switch valve (not shown) with a pressure source and a pressureless return system. In the working stroke, duct 36 is pressurized and duct 36' is connected to the return system. In the return stroke, duct 36' is pressurized and duct 36 is pressureless.

The inner piston 41 is arranged coaxially within the outer piston 38. In this example, the inner piston 41 has a piston head 41*a* provided with sealings, piston head 41*a* being displaceable in cylinder 40 arranged within outer piston 38.

A counterpressure chamber 52 is provided in cylinder 34 on the side facing away from pressure chamber 39, and a counterpressure chamber 53 is provided in cylinder 40 on the side facing away from pressure chamber 39. These two counterpressure chambers 52 and 53 are interconnected by radial bores 54 in piston rod 38*b*. Bores 55 lead from counterpressure chamber 52 to a duct 56 represented by chain-dotted lines in FIG. 6, duct 56 being connected to counterpressure duct 36'.

The front end of piston rod 38*b* has fastened thereto a plate 57 forming an abutment for preventing that piston 41 slides out of piston 38.

In a working stroke, pressure chamber 39 is pressurized, and both pistons 38 and 41 move in the direction of pressure member 26. When abutment 45 of piston 41 contacts abutment 46, movement of the outer piston 38 is terminated whereas inner piston 41 travels further forward so that, for the largest part of the working stroke, only the inner piston moves lever 18. This forward movement is ended upon detection of a pressure rise in line 36.

In the subsequent return stroke, line 36 is made pressureless and line 36' is pressurized. By the pressure in counterpressure chambers 52 and 53, both pistons 38 and 41 are moved back within their respective cylinders until reaching the position shown in FIG. 6, lever 18 following behind under the effect of spring 22.

Also the device of FIG. 6 can be provided with a locking member 47 as described with respect to the first embodiment, or with a valve 60.

I claim:

1. A pressure medium operated power wrench comprising a head piece (10) including a rotatably supported annular member (14), lever means (18) for rotating the annular member (14), drive means (11) for moving the lever means (18) to in turn rotate the annular member (14), said drive means (11) includes a first cylinder (34) and its associated first piston (38) and a second cylinder (40) and its associated second piston (41), said first and second pistons (38, 41) having first end portions adjacent said lever means (18) and second end portions remote therefrom, said second end portions being subject to a pressure medium to effect movement of both said first and second pistons (38, 41, respectively) in a first direction along a first portion of a path of travel toward said lever (18), abutment means (45, 46) for limiting the length of travel of said first piston (38) in said first direction to a predetermined length of travel defined by said first path portion, and said second piston (41) being constructed and arranged to travel in said first direction beyond said predetermined length of travel and said first path portion along a second path portion whereby said second piston (41) is displaceable upon the termination of travel of said first piston (38) by said abutment means (45, 46).

2. The power wrench as defined in claim 1 wherein said second cylinder (40) is a bore of said first piston (38).

3. The power wrench as defined in claim 1 including a pressure member (26) arranged between said first and second piston first end portions and said lever means (18).

4. The power wrench as defined in claim 1 including a pressure member (26) arranged between said first and second piston first end portions and said lever means (18), and said pressure member (26) includes a fork within which is seated a portion of said lever means (18).

5. The power wrench as defined in claim 1 including a pressure member (26) arranged between said first and second piston first end portions and said lever means (18), said pressure member (26) includes a fork within which is seated a portion of said lever means (18), and means (24) for connecting said fork to said lever means (18).

6. The power wrench as defined in claim 1 including a pressure member (26) arranged between said first and second piston first end portions and said lever means (18), said pressure member (26) includes a fork within which is seated a portion of said lever means (18), means (24) for connecting said fork to said lever means (18), said means (24) include a pin having sliding faces (25), and said fork has legs bearing against said sliding faces (25).

7. The power wrench as defined in claim 1 including a pressure member (26) arranged between said first and second piston first end portions and said lever means (18), said pressure member (26) includes a fork within which is seated a portion of said lever means (18), means (24) for connecting said fork to said lever means (18), said means (24) include a pin having sliding faces (25), said fork has legs bearing against said sliding faces (25), and said sliding faces (25) are disposed in a radial plane relative to an axis of said pin.

8. The power wrench as defined in claim 1 including a pressure member (26) arranged between said first and second piston first end portions and said lever means (18), said pressure member (26) includes a fork within which is seated a portion of said lever means (18), means (24) for connecting said fork to said lever means (18), said means (24) include a pin having sliding faces (25), said fork has legs bearing against said sliding faces (25), and said legs have surfaces which are oblique relative to said path of travel.

9. The power wrench as defined in claim 1 including a pressure member (26) arranged between said first and second piston first end portions and said lever means (18), said pressure member (26) includes a fork within which is seated a portion of said lever means (18), means (24) for connecting said fork to said lever means (18), said means (24) include a pin having sliding faces (25), said fork has legs bearing against said sliding faces (25), said sliding faces (25) are disposed in a radial plane relative to an axis of said pin, and said legs have surfaces which are oblique relative to said path of travel.

10. The power wrench as defined in claim 1 including means (47, 49) for locking the lever means (18) at a position at which said lever means (18) cannot be contacted by said first piston first end portion but can be contacted by said second piston first end portion whereby movement of said lever means (18) is effected exclusively by said second piston (41).

11. The power wrench as defined in claim 1 wherein said first piston (38) and first cylinder (34) cooperatively define a pressure chamber (39) and a counterpressure chamber (52), and duct means (36') for connecting said counterpressure chamber (52) to a pressure control system (60).

12. The power wrench as defined in claim 1 wherein said first piston (38) and first cylinder (34) cooperatively define a pressure chamber (39) and a counterpressure chamber (52), duct means (36') for connecting said counterpressure chamber (52) to a pressure control system (60), and said pressure control system (60) includes pressure-operated valve means (62, 63) for connecting the counterpressure chamber (52) to the duct means (36') only when pressure in the counterpressure chamber (52) exceeds a predetermined value.

13. The power wrench as defined in claim 2 including a pressure member (26) arranged between said first and second piston first end portions and said lever means (18).

14. The power wrench as defined in claim 2 including a pressure member (26) arranged between said first and second piston first end portions and said lever means (18), and said pressure member (26) includes a fork within which is seated a portion of said lever means (18).

15. The power wrench as defined in claim 2 including means (47, 49) for locking the lever means (18) at a position at which said lever means (18) cannot be contacted by said first piston first end portion but can be contacted by said second piston first end portion whereby movement of said lever means (18) is effected exclusively by said second piston (41).

16. The power wrench as defined in claim 2 wherein said first piston (38) and first cylinder (34) cooperatively define a pressure chamber (39) and a counterpressure chamber (52), and duct means (36') for connecting said counterpressure chamber (52) to a pressure control system (60).

17. The power wrench as defined in claim 3 including means (47, 49) for locking the lever means (18) at a position at which said lever means (18) cannot be contacted by said first piston first end portion but can be contacted by said second piston first end portion whereby movement of said lever means (18) is effected exclusively by said second piston (41).

18. The power wrench as defined in claim 17 wherein said locking means (47, 49) includes a locking member (49) which in a locked position thereof allows movement of said pressure member (26) in said first direction.

* * * * *